US010459395B2

(12) United States Patent
Sato et al.

(10) Patent No.: US 10,459,395 B2
(45) **Date of Patent: *Oct. 29, 2019**

(54) IMAGE FORMING APPARATUS

(71) Applicant: Brother Kogyo Kabushiki Kaisha, Nagoya-shi, Aichi-ken (JP)

(72) Inventors: Shougo Sato, Seto (JP); Yasuo Fukamachi, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/195,137

(22) Filed: Nov. 19, 2018

(65) Prior Publication Data

US 2019/0086858 A1 Mar. 21, 2019

Related U.S. Application Data

(63) Continuation of application No. 15/927,661, filed on Mar. 21, 2018, now Pat. No. 10,175,628.

(30) Foreign Application Priority Data

Jul. 6, 2017 (JP) ..... 2017-133098

(51) Int. Cl.

| | |
|---|---|
| ***G03G 15/00*** | (2006.01) |
| ***G03G 21/16*** | (2006.01) |
| ***G03G 21/18*** | (2006.01) |

(52) U.S. Cl.

CPC ..... *G03G 15/751* (2013.01); *G03G 21/1671* (2013.01); *G03G 21/1853* (2013.01)

(58) Field of Classification Search

CPC ..... G03G 15/751; G03G 21/1671; G03G 21/1853

See application file for complete search history.

(56) References Cited

U.S. PATENT DOCUMENTS

2015/0277345 A1 10/2015 Yokoi
2016/0070227 A1* 3/2016 Wada ..... G03G 21/1832 399/128

FOREIGN PATENT DOCUMENTS

JP 2006-003690 A 1/2006

* cited by examiner

*Primary Examiner* — David M. Gray
*Assistant Examiner* — Michael A Harrison
(74) *Attorney, Agent, or Firm* — Banner & Witcoff, Ltd.

(57) ABSTRACT

A third contact portion contacts a first contact portion when a drum cartridge moves from first to second guide position. A fourth contact portion contacts a second contact portion when the drum cartridge moves from second to third guide position. When the drum cartridge moves from the first guide position to the second guide position, due to contact of the first contact portion with the third contact portion, the first cover located at the first position rotationally moves in a same rotational direction as the particular rotational direction to be located at the second position. When the drum cartridge moves from the second guide position to the third guide position, due to contact of the second contact portion with the fourth contact portion, the drum cartridge moves from the second guide position to the third guide position in a state where the first cover is kept at the second position.

13 Claims, 13 Drawing Sheets

IMAGE FORMING APPARATUS

CROSS REFERENCE TO RELATED APPLICATIONS

This application is a continuation of U.S. patent application Ser. No. 15/927,661 filed Mar. 21, 2018 which claims priority from Japanese Patent Application No. 2017-133098 filed Jul. 6, 2017. The entire content of the priority applications are incorporated herein by reference.

TECHNICAL FIELD

This disclosure relates to an image forming apparatus.

BACKGROUND

Conventionally, an image forming apparatus including a main casing and a drum cartridge that is mounted on the main casing is known.

The drum cartridge has a photosensitive drum and a cover covering the photosensitive drum. The drum includes two plates coupled to each other. The cover moves from a first position covering the photosensitive drum to a second position exposing the photosensitive drum when the drum cartridge is mounted onto the main casing. At this time, the cover is folded to cause the two plates to overlap each other.

SUMMARY

According to one aspect, this specification discloses an image forming apparatus. The image forming apparatus includes a main casing, a fixing device, and a drum cartridge. The fixing device is accommodated in the main casing. The drum cartridge is configured to be mounted on the main casing. The drum cartridge has a photosensitive drum and a first cover configured to cover a circumferential surface of the photosensitive drum. The main casing has a guide configured to guide the drum cartridge when the drum cartridge is mounted onto the main casing. The guide has an upstream end and a downstream end in a mounting direction in which the drum cartridge is guided by the guide when the drum cartridge is mounted onto the main casing. The downstream end is located between the upstream end and the fixing device. The drum cartridge has a guided portion configured to be guided by the guide. The drum cartridge is configured to move from a first guide position through a second guide position to a third guide position when the drum cartridge is mounted onto the main casing. The first guide position is a position at which the guided portion is located at the upstream end of the guide. The second guide position is a position at which the guided portion is located at the downstream end of the guide. The third guide position is a position at which the drum cartridge is rotationally moved, in a particular rotational direction, from the second guide position about the guided portion located at the downstream end. The first cover is configured to rotationally move about a first rotational shaft between a first position at which the first cover covers the circumferential surface of the photosensitive drum and a second position at which the first cover exposes the circumferential surface of the photosensitive drum. The first cover has a first contact portion and a second contact portion located at an opposite side of the first contact portion with respect to the first rotational shaft in the mounting direction. The main casing has a third contact portion and a fourth contact portion. The third contact portion is configured to contact the first contact portion when the drum cartridge moves from the first guide position to the second guide position. The fourth contact portion is configured to contact the second contact portion when the drum cartridge moves from the second guide position to the third guide position. The drum cartridge is configured such that: when the drum cartridge moves from the first guide position to the second guide position, due to contact of the first contact portion with the third contact portion, the first cover located at the first position rotationally moves in a same rotational direction as the particular rotational direction to be located at the second position; and when the drum cartridge moves from the second guide position to the third guide position, due to contact of the second contact portion with the fourth contact portion, the drum cartridge moves from the second guide position to the third guide position in a state where the first cover is kept at the second position.

BRIEF DESCRIPTION OF THE DRAWINGS

Embodiments in accordance with this disclosure will be described in detail with reference to the following figures wherein.

DETAILED DESCRIPTION

Figure 1:
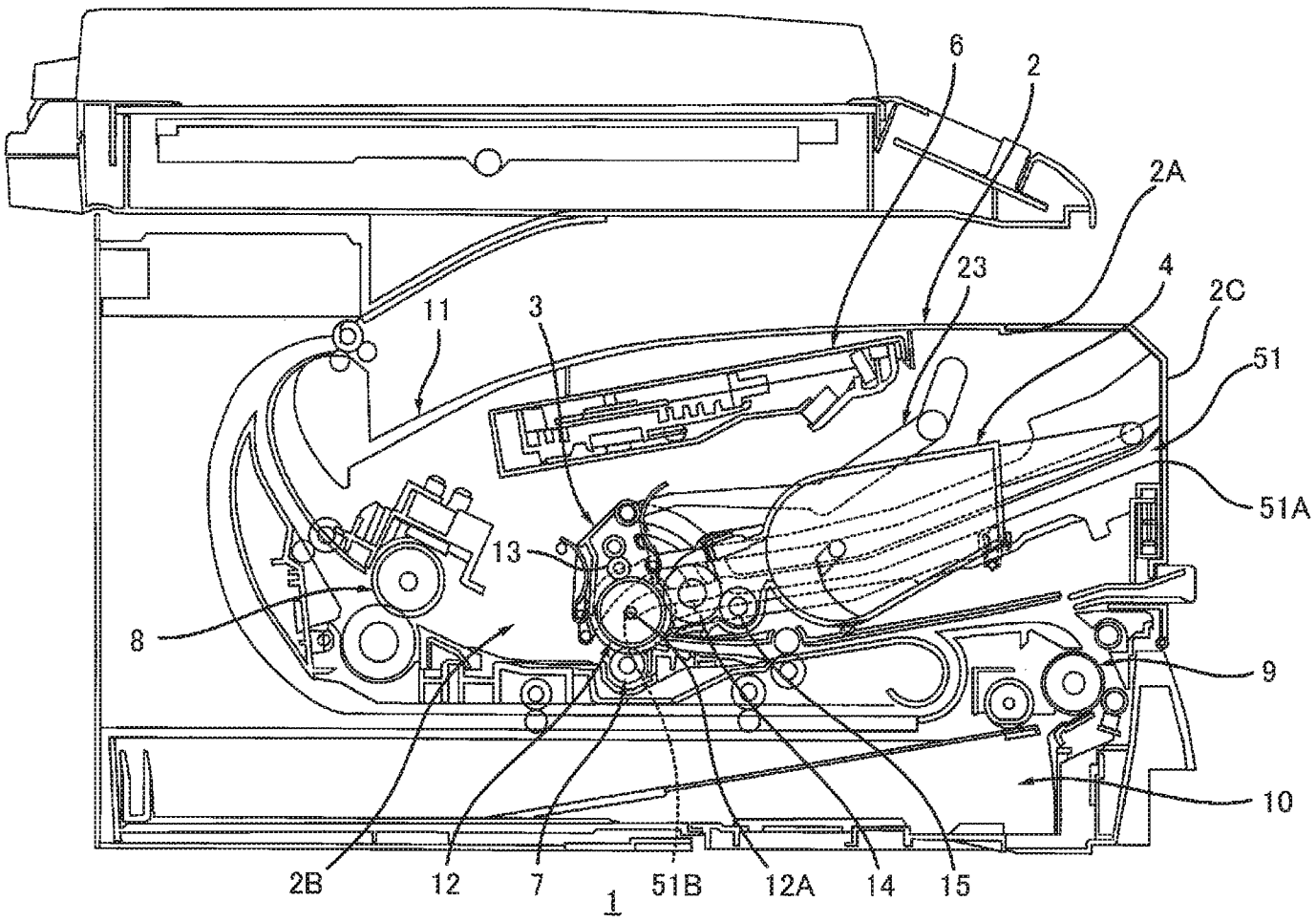
FIG. 1 is a central cross-sectional view of an image forming apparatus.

The above-mentioned drum cartridge has a complicated cover structure.

An example of an object of this disclosure is to provide an image forming apparatus which moves a first cover from a first position to a second position with a simple configuration by using a mounting operation of a drum cartridge onto a main casing.

1. Overview of Image Forming Apparatus 1

An overview of an image forming apparatus 1 will be described while referring to FIG. 1.

The image forming apparatus 1 includes an apparatus main body, a drum cartridge 3, and a developing cartridge 4.

1.1 Apparatus Main Body

The apparatus main body includes a main casing 2, a laser scanner unit 6, a transfer roller 7, a fixing device 8, a paper feeder 9, a paper feed tray 10, and a paper discharge tray 11. The main casing 2 has an opening 2A to mount the drum cartridge 3 and the developing cartridge 4 onto the main casing 2 and an internal space 2B communicating with the opening 2A. The opening 2A is commonly used when the drum cartridge 3 is mounted onto the main casing 2 and when the developing cartridge 4 is mounted onto the main casing 2. The internal space 2B accommodates the drum cartridge 3 and the developing cartridge 4 therein. The internal space 2B is located between the fixing device 8 and a cover 2C described later and between the laser scanner unit 6 and the transfer roller 7 described later. The main casing 2 includes the cover 2C. The main casing 2 accommodates therein the laser scan unit 6, the transfer roller 7, the fixing device 8, the paper feeder 9, and the paper feed tray 10.

The main casing 2 is configured to move between an open position (see FIG. 8) at which the opening 2A opens and a closed position (see FIG. 1) at which the opening 2A is closed.

The laser scan unit 6 is configured to expose the surface of a photosensitive drum 12 described later.

The transfer roller 7 is configured to transfer a toner image formed on the surface of the photosensitive drum 12 onto a sheet of paper. The transfer roller 7 contacts the surface of the photosensitive drum 12 in a state where the drum cartridge 3 is mounted on the main casing 2.

The fixing device 8 is configured to heat and press the sheet of paper to which the toner image is transferred to fix the toner image on the sheet of paper.

The paper feeder 9 is configured to supply a sheet of paper in the paper feed tray 10 into between the photosensitive drum 12 and the transfer roller 7.

The paper feed tray 10 is configured to store sheets of paper.

The paper discharge tray 11 is configured to receive a discharged sheet of paper having passed through the fixing device 8.

1.2 Drum Cartridge 3

The drum cartridge 3 is configured to be mounted on the main casing 2. The drum cartridge 3 includes a photosensitive drum 12, and a charging roller 13.

The photosensitive drum 12 is rotatable around a drum shaft 12A extending in an axial direction.

The charging roller 13 is configured to charge the surface of the photosensitive drum 12. The charging roller 13 contacts the surface of the photosensitive drum 12.

1.3 Developing Cartridge 4

The developing cartridge 4 is configured to be mounted on the main casing 2 independently from the drum cartridge 3. The developing cartridge 4 includes a developing roller 14 and a supply roller 15.

The developing roller 14 is configured to supply toner to the photosensitive drum 12. The developing roller 14 contacts the surface of the photosensitive drum 12 in a state where the drum cartridge 3 and the developing cartridge 4 are mounted on the main casing 2. The developing roller 14 may be in proximity to the surface of the photosensitive drum 12 with a space therebetween in a state where the drum cartridge 3 and the developing cartridge 4 are mounted on the main casing 2.

The supply roller 15 is configured to supply the toner in the developing cartridge 4 to the developing roller 14. The supply roller 15 is located in the developing cartridge 4. The supply roller 15 contacts the surface of the developing roller 14.

1A. Details of Image Forming Apparatus 1

The details of the image forming apparatus 1 will be described while referring to FIG. 2A to FIG. 13.

Figure 2A:
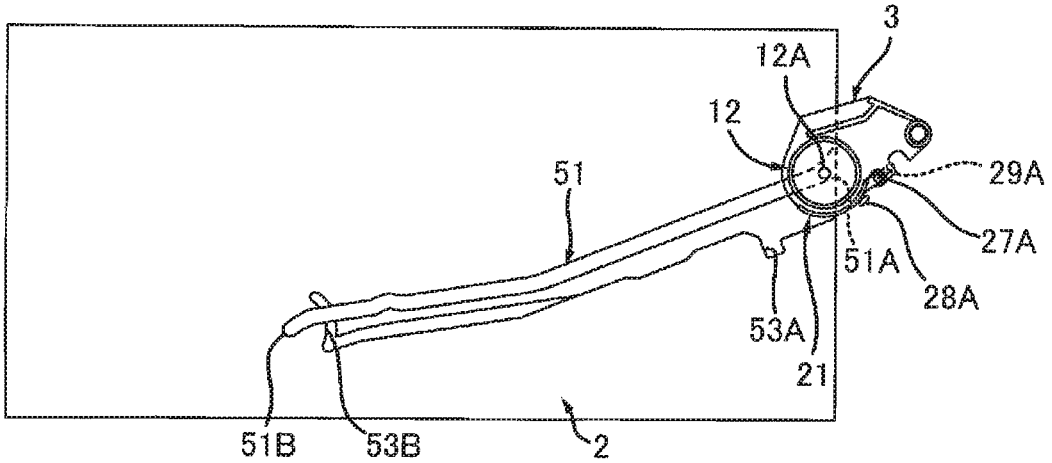
FIG. 2A is an explanatory diagram for explaining an outline of this disclosure, and shows a state where a drum cartridge is located at a first guide position.
Figure 2B:
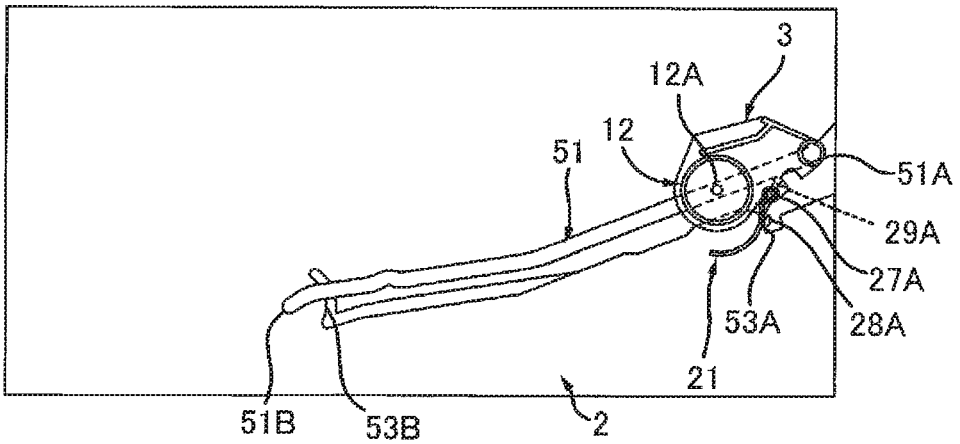
FIG. 2B shows a state where, continuing from FIG. 2A, the drum cartridge moves from the first guide position to a second guide position to bring a first contact portion of a first cover into contact with a third contact portion of the main casing.
Figure 2C:
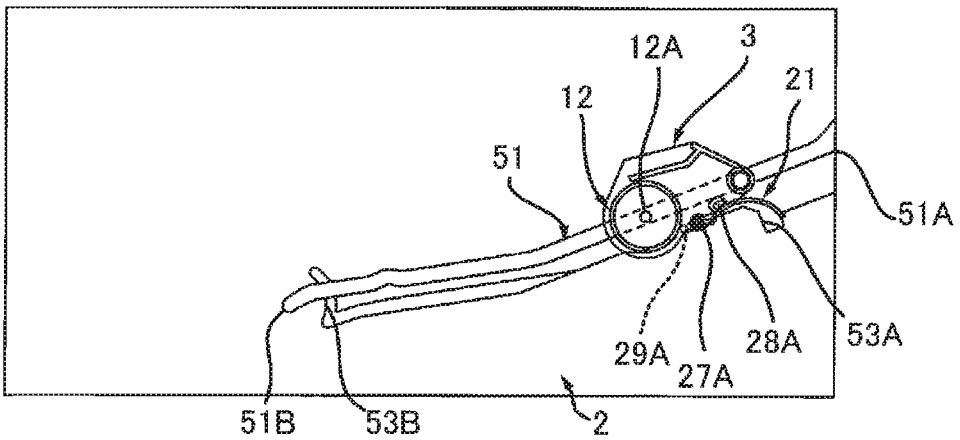
FIG. 2C shows a state where, continuing from FIG. 2B, the drum cartridge further moves from the first guide position to the second guide position to cause the first cover to be located at a second position.
Figure 3A:
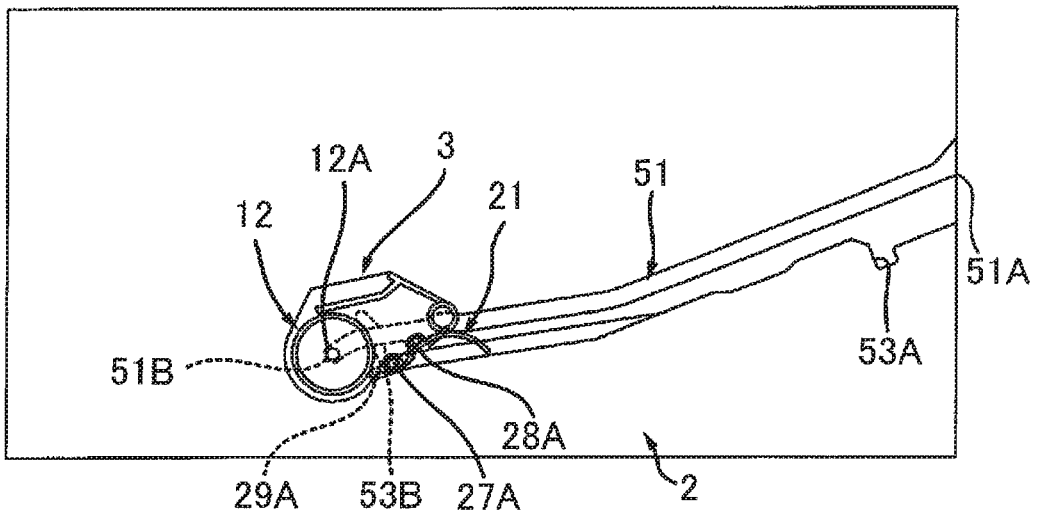
FIG. 3A shows a state where, continuing from FIG. 2C, the drum cartridge is located at the second guide position.

As shown in FIG. 2A to FIG. 3B, the drum cartridge 3 is configured to, when mounted onto the main casing 2, move from a first guide position (see FIG. 2A) to a third guide position (see FIG. 3B) through a second guide position (see FIG. 3A). The first guide position is a position where the drum shaft 12A is located at an upstream end 51A of a guide 51 described later. The second guide position is a position where the drum shaft 12A is located at a downstream end 51B of the guide 51. The third guide position is a position at which the drum cartridge 3 is rotationally moved from the second guide position about the drum shaft 12A located at the downstream end 51B.

The drum cartridge 3 has a first cover 21 described later. The first cover 21 can rotationally move about a first rotational shaft 27A between a first position (see FIG. 2A) covering the circumferential surface of the photosensitive drum 12 and a second position (see FIG. 2C) exposing the circumferential surface of the photosensitive drum 12.

The first cover 21 has a first contact portion 28A described later and a second contact portion 29A described later. The main casing 2 has a third contact portion 53A described later and a fourth contact portion 53B described later.

As shown in FIG. 2B, the third contact portion 53A contacts the first contact portion 28A when the drum cartridge 3 moves from the first guide position to the second guide position. In this manner, as shown in FIG. 2B and FIG. 2C, the first cover 21 located at the first position rotationally moves in the same direction as a rotational direction in which the drum cartridge 3 rotationally moves from the second guide position to the third guide position and is located at the second position.

Figure 3B:
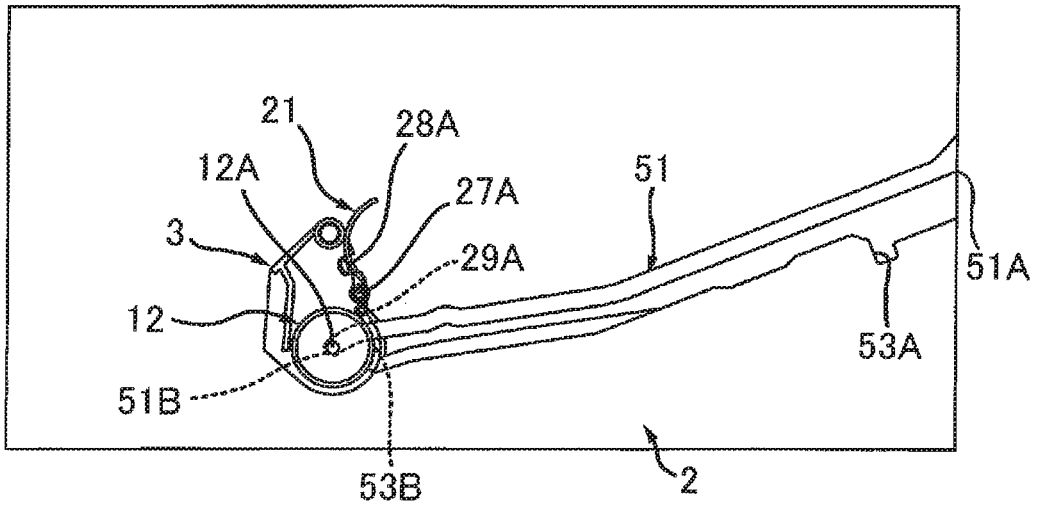
FIG. 3B shows a state where, continuing from FIG. 3A, the drum cartridge is rotationally moved from the second guide position to a third guide position.

As shown in FIG. 3A, the fourth contact portion 53B contacts the second contact portion 29A when the drum cartridge 3 moves from the second guide position to the third guide position. In this manner, as shown in FIG. 3A and FIG. 3B, the drum cartridge 3 moves from the second guide position to the third guide position in a state where the first cover 21 is kept at the second position.

Detailed structures of the drum cartridge 3, the developing cartridge 4, and the main casing 2 will be described below.

2. Details of the Drum Cartridge 3

Figure 4A:
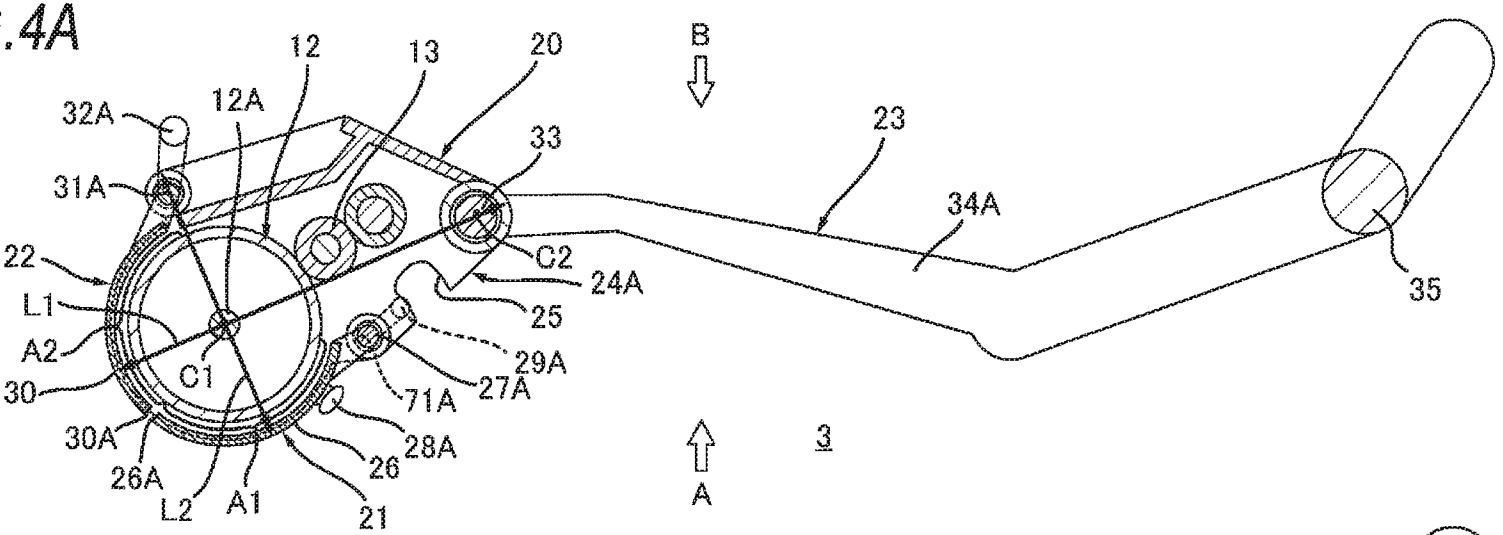
FIG. 4A shows the drum cartridge shown in FIG. 1, and a state where the first cover is located at the first position and a second cover is located at a third position.

As shown in FIG. 4A, the drum cartridge 3 has a length L1 except for a handle 23 in a direction in which a central axis line C1 of the drum shaft 12A and a central axis line C2 of a handle shaft 33 described later are connected to each other. The drum cartridge 3 has a length L2 in a direction perpendicular to a direction in which the central axis line C1 and the central axis line C2 are connected to each other. The length L2 is shorter than the length L1. This reduces a space, in the upper-lower direction in the main casing 2, through which the drum cartridge 3 passes when the drum cartridge 3 moves from the first guide position to the second guide position, thereby reducing the main casing 2 in thickness.

The drum cartridge 3 includes the photosensitive drum 12, the charging roller 13, a drum frame 20, the first cover 21, the second cover 22, and the handle 23. The drum cartridge 3 includes the first cover 21 and the second cover 33 to cover a wide area of the circumferential surface of the photosensitive drum 12, thereby reliably protecting the circumferential surface of the photosensitive drum 12.

2. 1 Drum Frame 20

The drum frame 20 houses the photosensitive drum 12 and the charging roller 13. The drum frame 20 rotatably supports the photosensitive drum 12. The drum frame 20 includes a side plate 24A and a side plate 24B (see FIG. 5).

The side plate 24A rotatably supports a one-end part of the drum shaft 12A in the axial direction. The side plate 24A has a cutout 25.

Figure 4B:
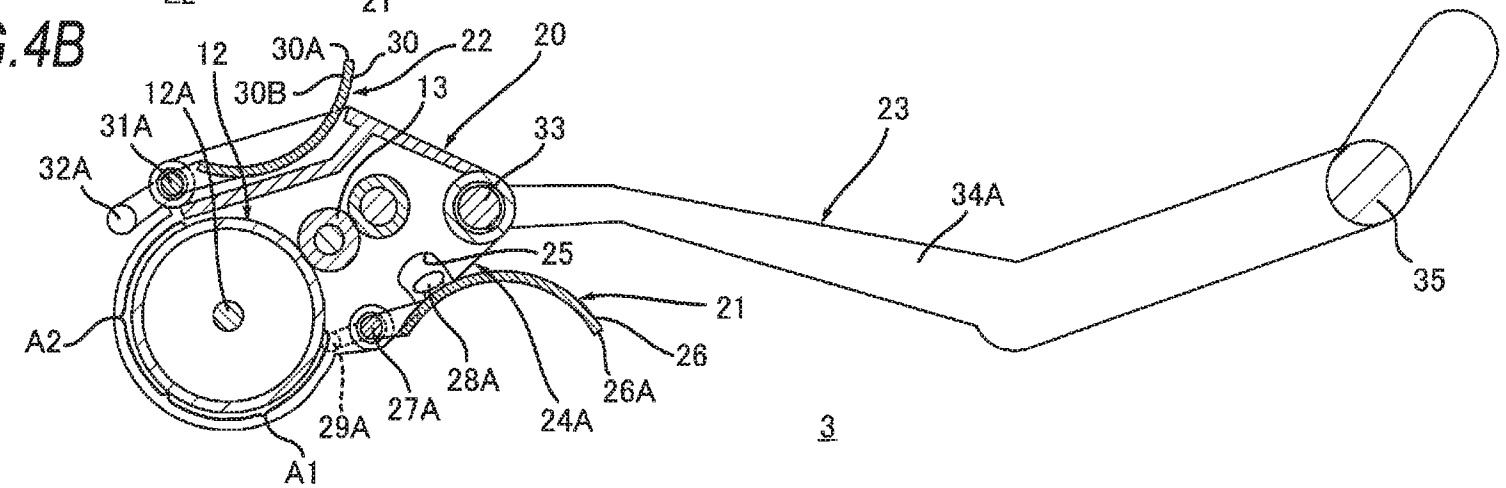
FIG. 4B shows the drum cartridge shown in FIG. 4A, and a state where the first cover is located at the second position and the second cover is located at a fourth position.

As shown in FIG. 4B, the cutout 25 receives a first contact portion 28A described later when the first cover 21 is located at the second position.

Figure 5:
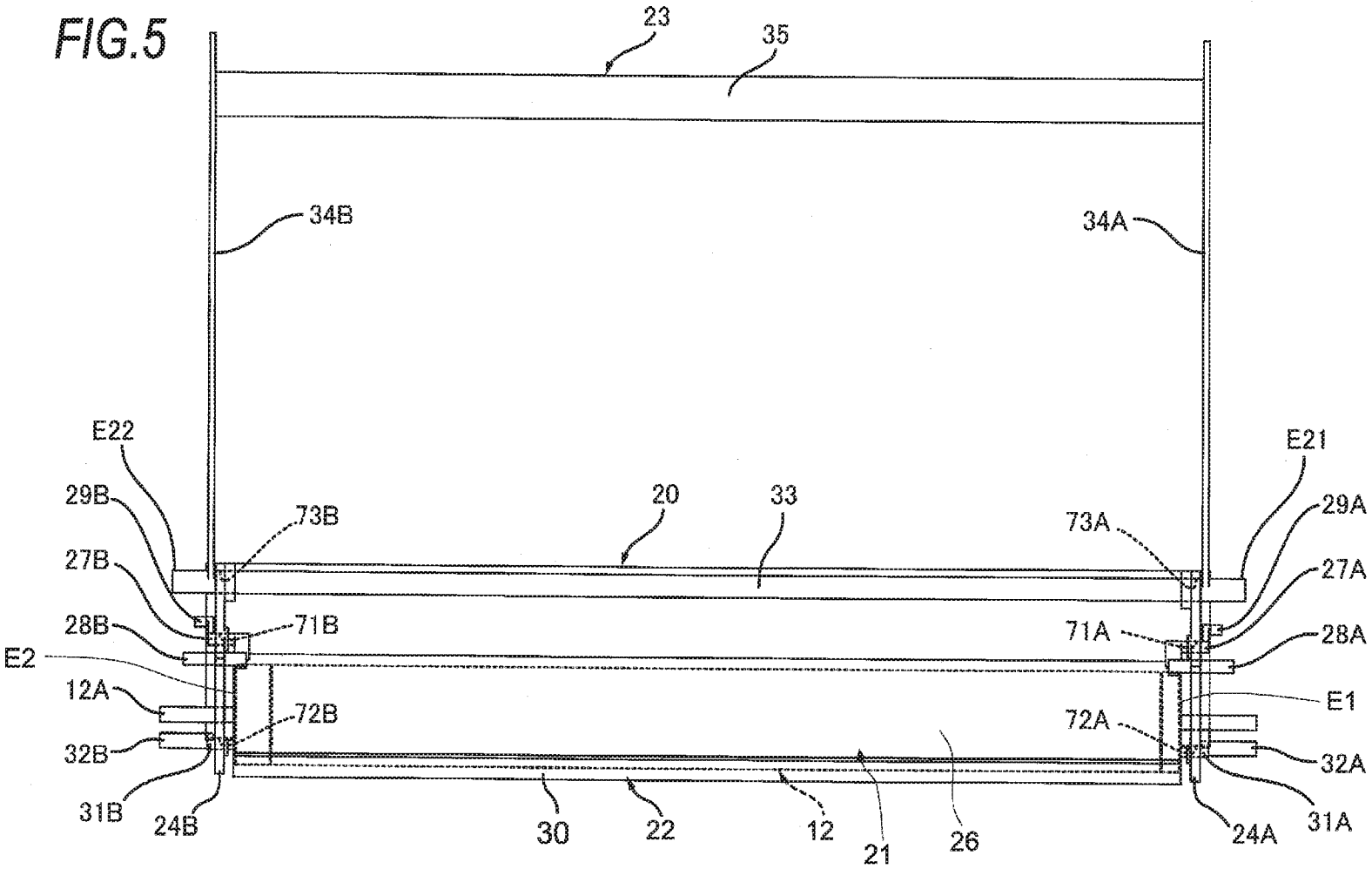
FIG. 5 is a view showing the drum cartridge shown in FIG. 4A when viewed from a direction of an arrow A (see FIG. 4A)

As shown in FIG. 5, the side plate 24B is located at an interval from the side plate 24A in the axial direction. The side plate 24B rotatably supports the other-end part of the drum shaft 12A in the axial direction. The side plate 24B has a cutout (not shown).

The cutout (not shown) receives a first contact portion 28B described later when the first cover 21 is located at the second position.

2. 2 First Cover 21

As shown in FIG. 4A, the first cover 21 has a cover plate 26, a first rotational shaft 27A, a first rotational shaft 27B (see FIG. 5), a first contact portion 28A, a first contact portion 28B (see FIG. 5), a second contact portion 29A, and a second contact portion 29B (see FIG. 5).

The cover plate 26 covers the circumferential surface of the photosensitive 12 when the first cover 21 is located at the first position. In this manner, the first cover 21 covers the circumferential surface of the photosensitive drum 12 when the first cover 21 is located at the first position. The cover plate 26 covers a first portion A1 that is a part of the circumferential surface of the photosensitive drum 12, when the first cover 21 is located at the first position. A developing roller 14 (see FIG. 1) contacts the first portion A1 in a state where the drum cartridge 3 is located at the third guide position. In a state where the drum cartridge 3 is located at the third guide position and the developing cartridge 4 is mounted on the main casing 2, the photosensitive drum 12 is located at a downstream side of the developing roller 14 in a direction in which the drum cartridge 3 moves from the first guide position to the second guide position. As shown in FIG. 5, the cover plate 26 is located between the side plate 24A and the side plate 24B in the axial direction. The cover plate 26 extends in the axial direction. The cover plate 26 has one end E1 and an other end E2. The cover plate 26 is curved along the circumferential surface of the photosensitive drum 12.

The first rotational shaft 27A is located at one end E1 of the cover plate 26. The first rotational shaft 27A extends in the axial direction. The first rotational shaft 27A has a columnar shape. The first rotational shaft 27A is rotatably supported by the side plate 24A. More specifically, the first rotational shaft 27A is rotatably supported by the side plate 24A by being inserted into a through hole 71A of the side plate 24A.

The first rotational shaft 27B is located at the other end E2 of the cover plate 26. The first rotational shaft 27B is located at an interval from the first rotational shaft 27A in the axial direction. The first rotational shaft 27B may be continuous with the first rotational shaft 27A. The first rotational shaft 27B extends in the axial direction. The first rotational shaft 27B has a columnar shape. The first rotational shaft 27B is rotatably supported by the side plate 24B. More specifically, the first rotational shaft 27B is rotatably supported by the side plate 24B by being inserted into a through hole 71B of the side plate 24B.

As shown in FIG. 4A, the first contact portion 28A is located at an opposite side of a recessed part 25 with respect to the first rotational shaft 27A. As shown in FIG. 5, the first contact portion 28A is located at the one end E1 of the cover plate 26. The first contact portion 28A extends in the axial direction. The first contact portion 28A extends to an opposite side of the cover plate 26 with respect to the side plate 24A in the axial direction. The first contact portion 28A has an elliptically columnar shape.

The first contact portion 28B is located at the other end E2 of the cover plate 26. The first contact portion 28B is located at a position overlapping the first contact portion 28A in the axial direction. The first contact portion 28B extends in the axial direction. The first contact portion 28B extends to the opposite side of the cover plate 26 with respect to the side plate 24B in the axial direction. The first contact portion 28B has an elliptically columnar shape.

As shown in FIG. 4A, the second contact portion 29A is located at an opposite side of the first contact portion 28A with respect to the first rotational shaft 27*a*. In this manner, the second contact portion 29A is located at the opposite side of the first contact portion 28A with respect to the first rotational shaft 27A in a mounting direction. The second contact portion 29A is located at an interval from the first rotational shaft 27A. The second contact portion 29A is connected to the first rotational shaft 27A. As shown in FIG. 5, the second contact portion 29A is located at the opposite side of the cover plate 26 with respect to the side plate 24A in the axial direction. The second contact portion 29A extends in the axial direction. The second contact portion 29A has a columnar shape.

The second contact portion 29B is located at an opposite side of the first contact portion 28B with respect to the first rotational shaft 27B. The second contact portion 29B is located at an interval from the first rotational shaft 27B. The second contact portion 29B is connected to the first rotational shaft 27B. The second contact portion 29B is located at the opposite side of the cover plate 26 with respect to the side plate 24B in the axial direction. The second contact portion 29B extends in the axial direction. The second contact portion 29B has a columnar shape.

2. 3 Second Cover 22

As shown in FIG. 4A and FIG. 4B, the second cover 22 is configured to rotationally move between a third position covering the circumferential surface of the photosensitive drum 12 (see FIG. 4A) and a fourth position (see FIG. 4B) exposing the circumferential surface of the photosensitive drum 12 with respect to a second rotational shaft 31A extending in the axial direction. The second cover 22 includes a cover plate 30, the second rotational shaft 31A, a second rotational shaft 31B (see FIG. 5), a fifth contact portion 32A, a fifth contact portion 32B (see FIG. 5), and an eighth contact portion 30B.

Figure 6:
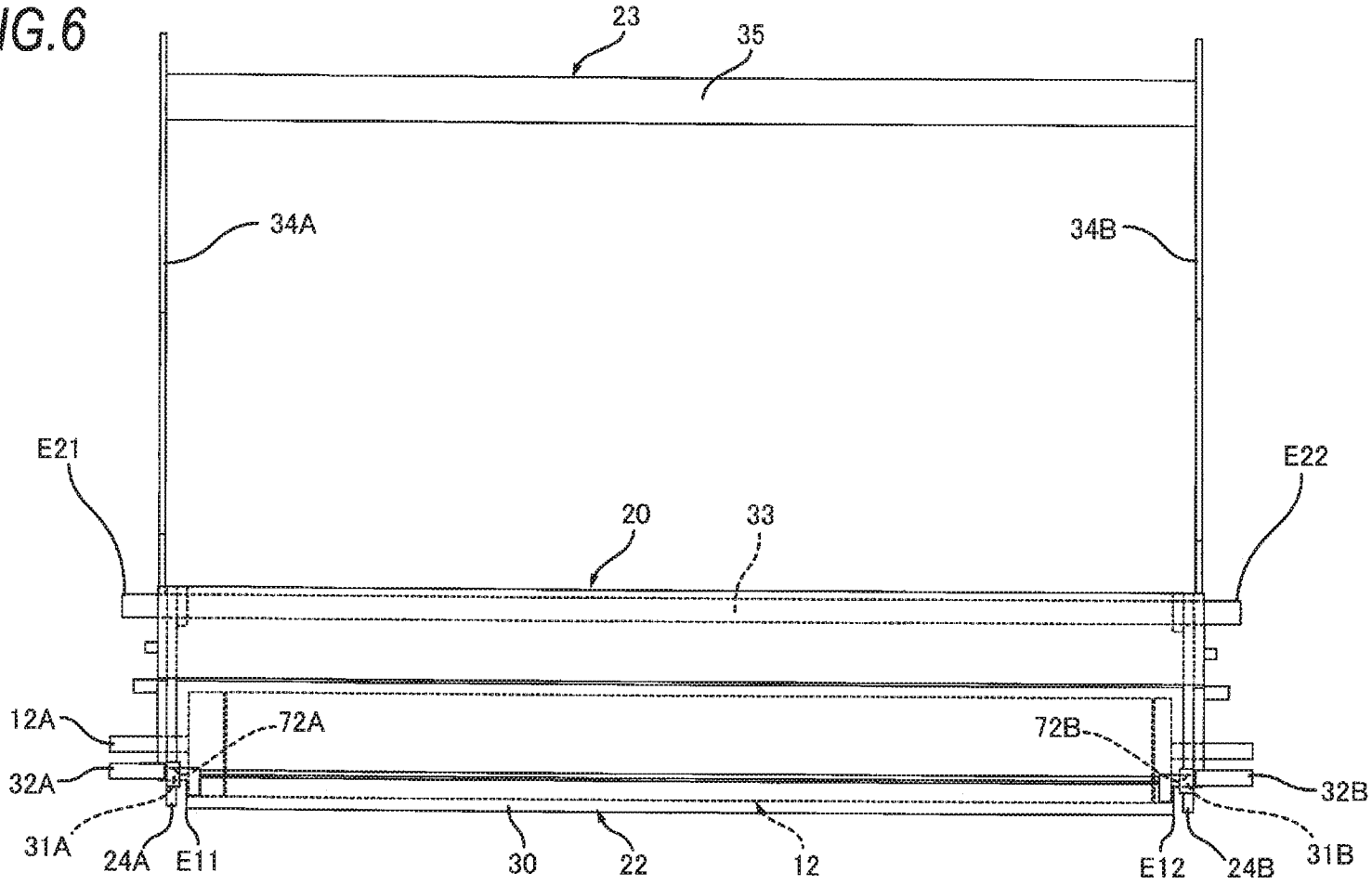
FIG. 6 is a view showing the drum cartridge shown in FIG. 4A when viewed from a direction of an arrow B (see FIG. 4A)

When the second cover 22 is located at the third position, the cover plate 30 covers a second portion A2 different from the first portion A1 on the circumferential surface of the photosensitive drum 12. Thereby, the second cover 22 covers the second portion A2 different from the first portion A1 of the circumferential surface of photosensitive 12A when the second cover 22 is located at the third position. The transfer roller 7 (see FIG. 1) contacts the second portion A2 in a state where the drum cartridge 3 is located at the third guide position. A free end 30A of the cover plate 30 faces a free end 26A of the cover plate 26 of the first cover 21 in a circumferential direction of the photosensitive drum 12 in a state where the first cover 21 is located at the first position and the second cover 22 is located at the third position. In this manner, the first cover 21 and the second cover 22 face each other in the circumferential direction of the photosensitive drum 12 in the state where the first cover 21 is located at the first position and the second cover 22 is located at the third position. At this time, the free end 30A of the cover plate 30 and the free end 26A of the cover plate 26 of the first cover 21 face each other. As shown in FIG. 6, the cover plate 30 is located between the side plate 24A and the side plate 24B in the axial direction. The cover plate 30 extends in the axial direction. The cover plate 30 has one end E11 and an other end E12 in the axial direction. The cover plate 30 is curved along the circumferential surface of the photosensitive drum 12.

The second rotational shaft 31A is located at the one end E11 of the second cover 22. The second rotational shaft 31A extends in the axial direction. The second rotational shaft 31A has a columnar shape. The second rotational shaft 31A is rotatably supported by the side plate 24A. More specifically, the second rotational shaft 31A is rotatably supported by the side plate 24A by being inserted into a through hole 72A of the side plate 24A.

The second rotational shaft 31B is located at the other end E12 of the second cover 22. The second rotational shaft 31B is located at an interval from the second rotational shaft 31A in the axial direction. The second rotational shaft 31B may be continuous with the second rotational shaft 31A. The second rotational shaft 31B extends in the axial direction. The second rotational shaft 31B has a columnar shape. The second rotational shaft 31B is rotatably supported by the side plate 24B. More specifically, the second rotational shaft 31B is rotatably supported by the side plate 24B by being inserted into a through hole 72B of the side plate 24B.

The fifth contact portion 32A is located at an opposite side of the cover plate 30 with respect to the second rotational shaft 31A. The fifth contact portion 32A is located at an interval from the second rotational shaft 31A. The fifth contact portion 32A is connected to the second rotational shaft 31A. The fifth contact portion 32A is located at the opposite side of the cover plate 30 with respect to the side plate 24A. The fifth contact portion 32A extends in the axial direction. The fifth contact portion 32A has a columnar shape.

The fifth contact portion 32B is located at the opposite side of the cover plate 30 with respect to the second rotational shaft 31B. The fifth contact portion 32B is located at an interval from the second rotational shaft 31B. The fifth contact portion 32B is connected to the second rotational shaft 31B. The fifth contact portion 32B is located at the opposite side of the cover plate 30 with respect to the side plate 24B in the axial direction. The fifth contact portion 32B extends in the axial direction. The fifth contact portion 32B has a columnar shape.

The eighth contact portion 30B is a part of the cover plate 30. The eighth contact portion 30B is located between the free end 30A of the cover plate 30 and the second rotational shaft 31A. The eighth contact portion 30B is a part that contacts a seventh contact portion 55 (see FIG. 13) described later when the drum cartridge 3 moves from the second guide position to the third guide position.

2. 4 Handle 23

As shown in FIG. 4A and FIG. 5, the handle 23 is rotationally movably coupled to the drum frame 20. The handle 23 includes a handle shaft 33 (an example of a coupling portion), a first arm 34A, a second arm 34B, and a bar 35.

Figure 10:
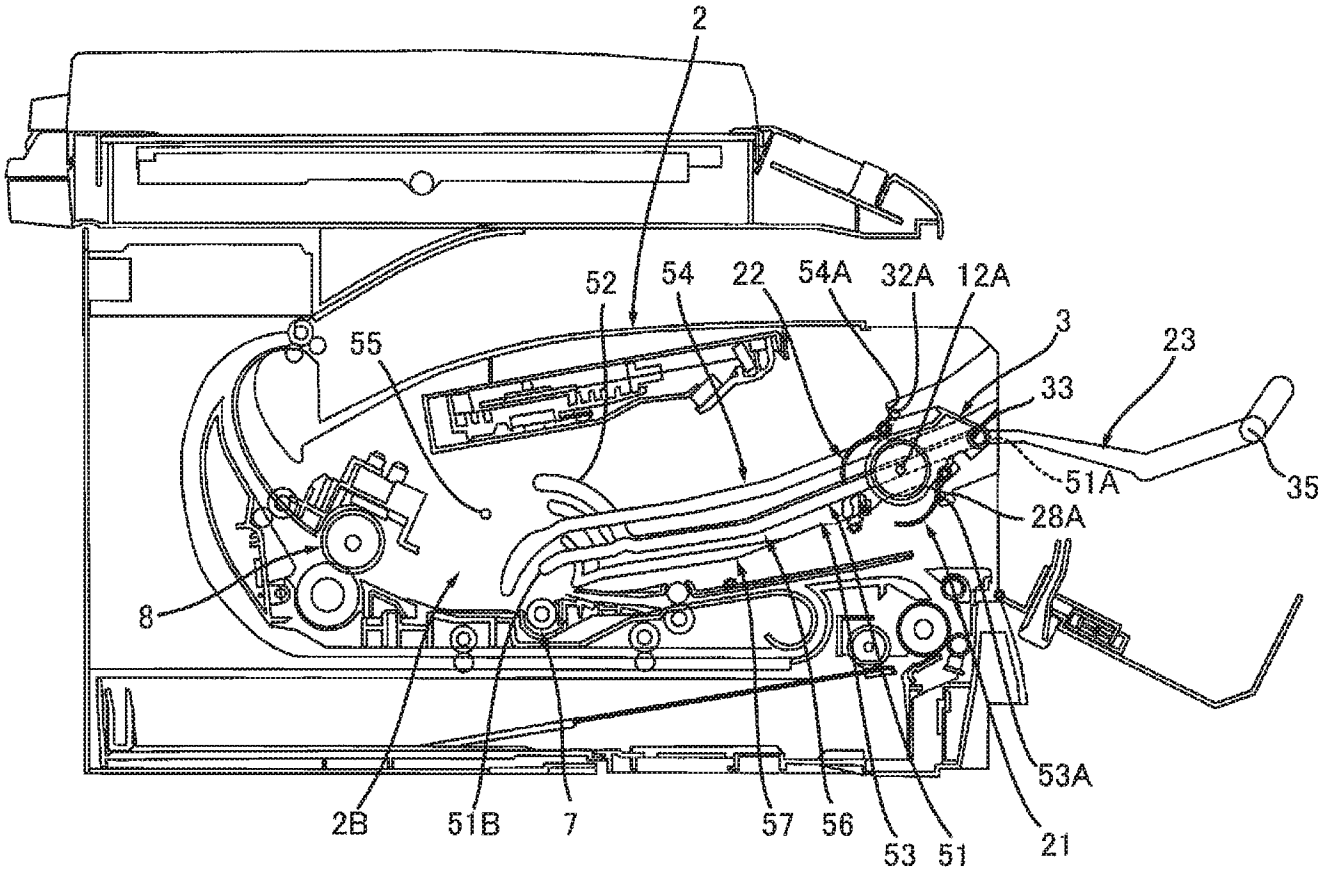
FIG. 10 shows a state where, continuing from FIG. 9, the drum cartridge moves from the first guide position to the second guide position, and a state where a first contact portion of the first cover contacts a third contact portion of the main casing and a fifth contact portion of the second cover contacts a sixth contact portion of the main casing.
Figure 11:
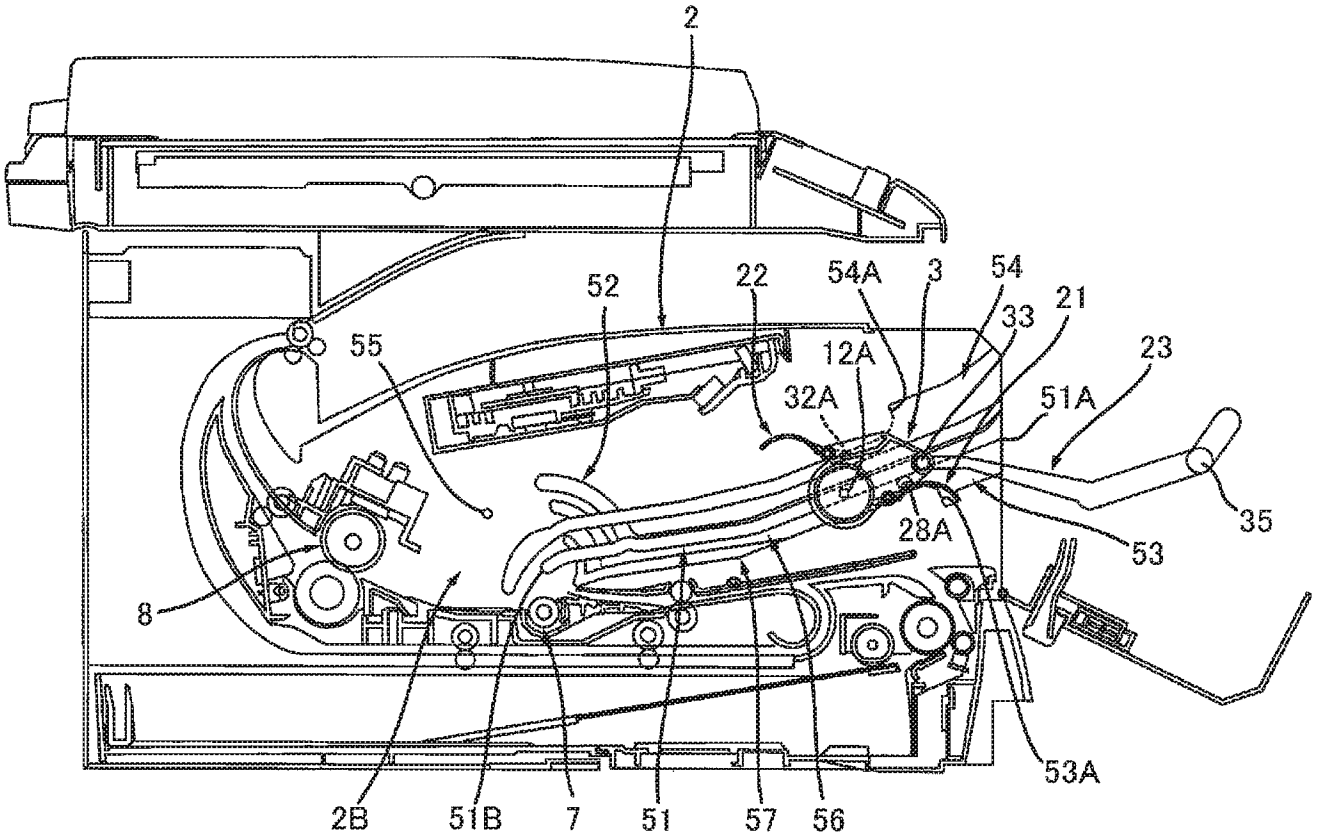
FIG. 11 shows a state where, continuing from FIG. 10, the drum cartridge further moves from the first guide position toward the second guide position, and a state where the first cover is located at the second position and the second cover is located at a fifth position.
Figure 12:
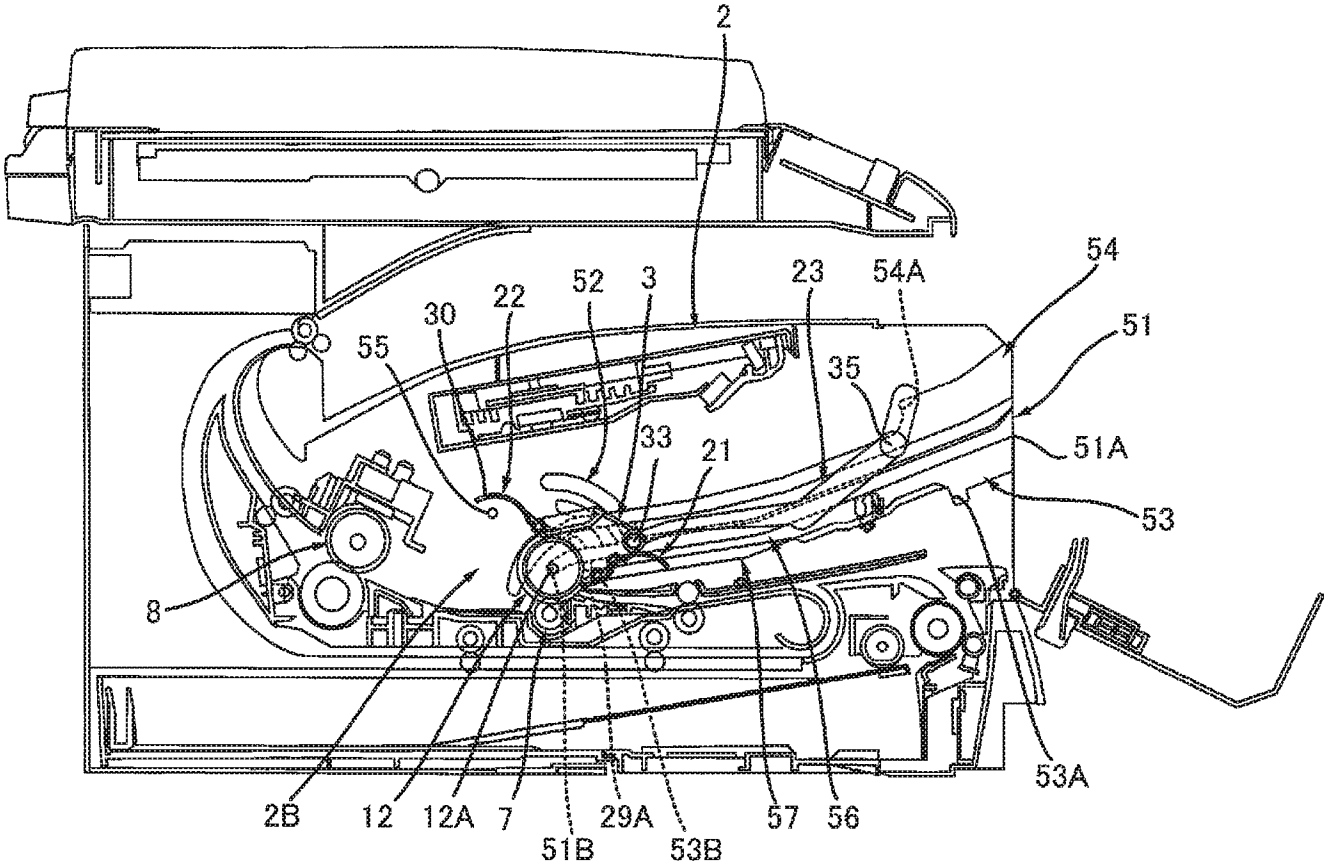
FIG. 12 shows a state where, continuing from FIG. 11, the drum cartridge is located at the second guide position.
Figure 13:
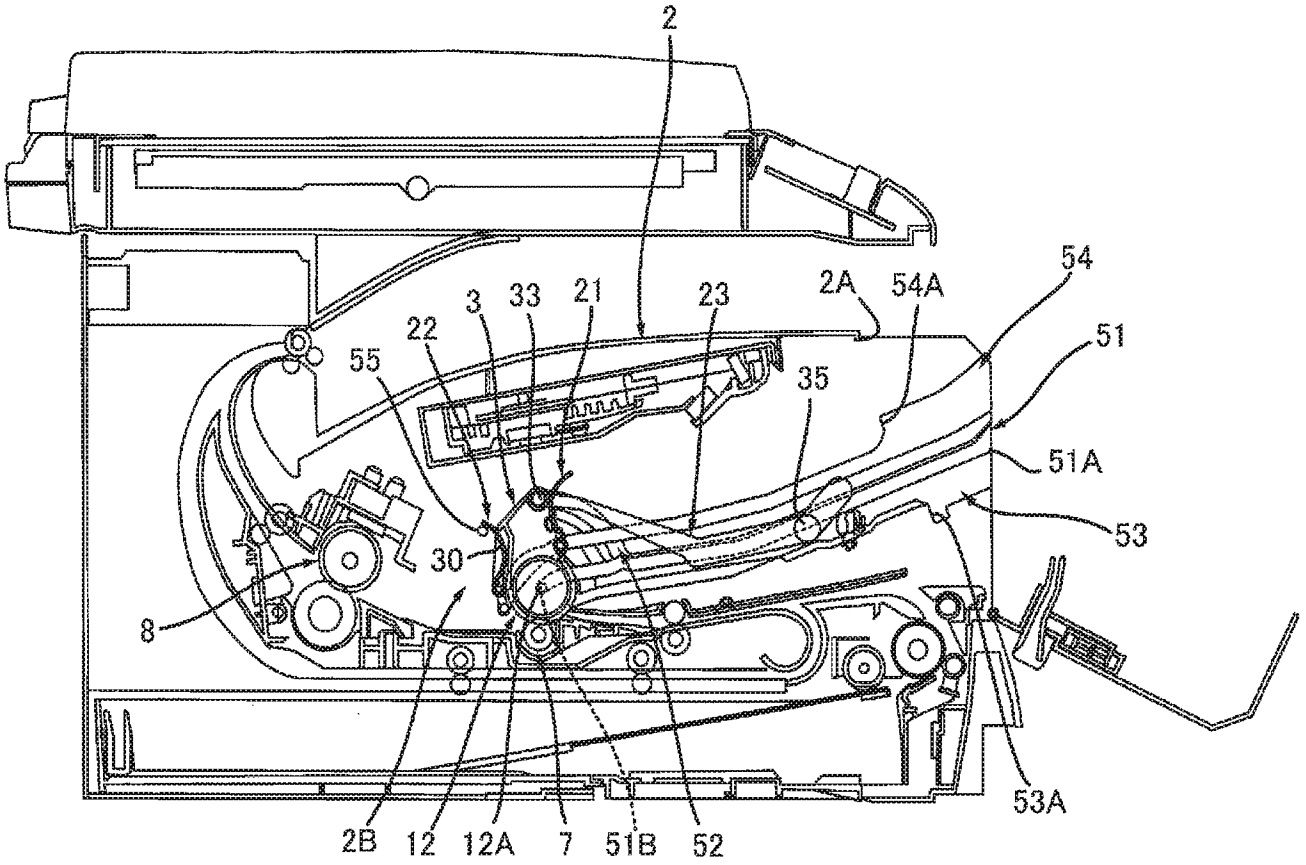
FIG. 13 shows a state where, continuing from FIG. 12, the drum cartridge is rotationally moved from the second guide position to the third guide position, and a state where the second cover is located at a fourth position.

The handle shaft 33 extends in the axial direction. The handle shaft 33 has one end E21 and an other end E22 in the axial direction. The handle shaft 33 has a columnar shape. The handle shaft 33 is inserted into the through hole 73A of the side plate 24A and the through hole 73B of the side plate 24B. In this manner, the handle shaft 33 is rotatably supported by the side plate 24A and the side plate 24B. In this manner, the first arm 34A is rotatably coupled to the drum frame 20. The second arm 34B is rotatably coupled to the drum frame 20. The coupling portion between the drum frame 20 and the first arm 34A or between the drum frame 20 and the second arm 34B is not limited to the handle shaft 33. For example, the drum frame 20 may have a first boss protruding from the side plate 24A and a second boss protruding from the side plate 24B, and the first arm 34A and the second arm 34B may have a hole or cutout in which the first boss is fitted and a hole or a cutout in which the second boss is fitted. In this case, a part of the first arm 34A and the second arm 34B having the hole or the cutout is included in the coupling portion. As shown in FIG. 9 to FIG. 12, the handle shaft 33 is located at an upstream of the photosensitive drum 12 in a direction in which the drum cartridge 3 moves from the first guide position to the second guide position when the drum cartridge 3 moves from the first guide position to the second guide position. As shown in FIG. 12 and FIG. 13, when the drum cartridge 3 moves from the second guide position to the third guide position, the handle shaft 33 retracts from the upstream of the photosensitive drum 12 in the moving direction. More specifically, the handle shaft 33 is located at a higher position when the drum cartridge 3 is located at the third guide position, than when the drum cartridge 3 is located at the second guide position.

As shown in FIG. 5, the first arm 34A, in the axial direction, is located between one end E21 of the handle shaft 33 and the side plate 24A. The first arm 34A extends from the handle shaft 33. The first arm 34A extends in a radial direction of the handle shaft 33.

The second arm 34B is located at an interval from the first arm 34A in the axial direction. The second arm 34B is located between the other end E22 of the handle shaft 33 and the side plate 24B in the axial direction. The second arm 34B extends from the handle shaft 33. The second arm 34B extends in the radial direction of the handle shaft 33.

The bar 35 is located at an interval from the handle shaft 33 in the radial direction of the handle shaft 33. The bar 35 is located between the first arm 34A and the second arm 34B in the axial direction. The bar 35 extends in the axial direction. The bar 35 has one end and an other end in the axial direction. The one end of the bar 35 is connected to the first arm 34A. The other end of the bar 35 is connected to the second arm 34B. The bar 35 has a columnar shape. As shown in FIG. 13, the bar 35 is located between the photosensitive drum 12 and the opening 2A of the main casing 2 in a state where the drum cartridge 3 is mounted on the main casing 2 and the developing cartridge 4 is detached from the main casing 2.

3. Details of Developing Cartridge 4

Figure 7:
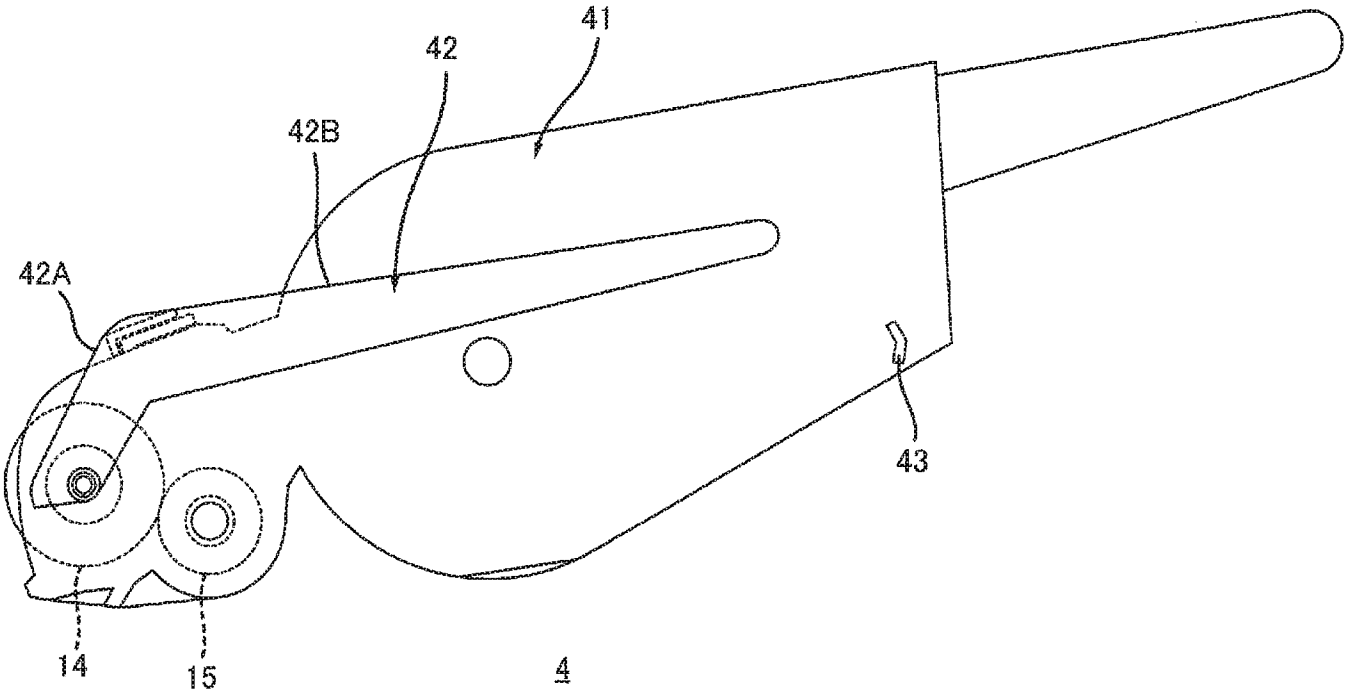
FIG. 7 is a side view of a developing cartridge shown in FIG. 1.

As shown in FIG. 7, the developing cartridge 4 includes a developing frame 41, a rib 42, and a rib 43.

The developing frame 41 stores toner therein. The developing frame 41 includes the developing roller 14 and a supply roller 15.

The rib 42 contacts the handle 23 (see FIG. 13) of the drum cartridge 3 when the developing cartridge 4 is mounted onto the main casing 2. The rib 42 is located on an outer surface of the developing frame 41 in the axial direction of the developing roller 14. The rib 42 protrudes from the outer surface of the developing frame 41 in the axial direction of the developing roller 14. The rib 42 has a first contact surface 42A and a second contact surface 42B.

When the developing cartridge 4 is mounted onto the main casing 2, the first contact surface 42A contacts the handle 23 (see FIG. 13) located between the photosensitive drum 12 and the opening 2A of the main casing 2, and rotationally moves the handle 23 upward. The first contact surface 42A is inclined relative to a development mounting direction when the developing cartridge 4 is mounted onto the main casing 2. The development mounting direction is a mounting direction of the developing cartridge 4 onto the main casing 2. More specifically, when the developing cartridge 4 is mounted onto the main casing 2, the first contact surface 42A is inclined upward toward the upstream in the development mounting direction.

The second contact surface 42B contacts the handle 23 (see FIG. 1) rotationally moved by the first contact surface 42A in a state where the developing cartridge 4 is mounted on the main casing 2. The second contact surface 42B extends in the development mounting direction in a state where the developing cartridge 4 is mounted on the main casing 2.

The rib 43 is pressed by a pressing member 60 (see FIG. 8) disposed in the main casing 2 in a state where the developing cartridge 4 is mounted on the main casing 2. The rib 43 is located on the outer surface of the developing frame 41 in the axial direction. The rib 43 protrudes from the outer surface of the developing frame 41 in the axial direction of the developing roller 14.

4. Details of Main Casing 2

Figure 8:
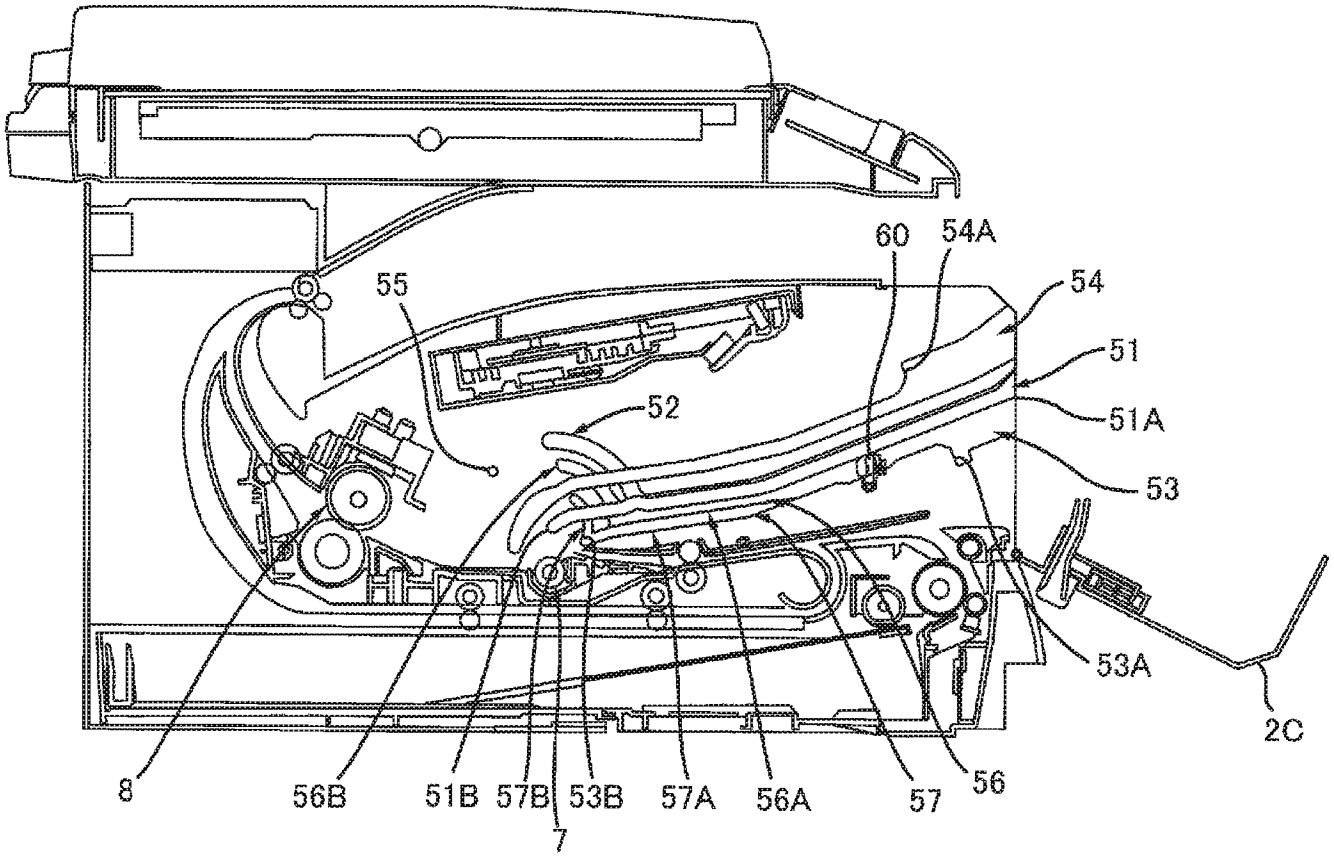
FIG. 8 is an explanatory diagram for explaining a main casing shown in FIG. 1, and a state where a cover is located at an open position.

As shown in FIG. 8, the main casing 2 includes the guide 51, a handle shaft guide 52, a first cover guide 53, a second cover guide 54, and a seventh contact portion 55.

4. 1 Guide 51

The guide 51 guides the drum cartridge 3 from the first guide position to the second guide position when the drum cartridge 3 is mounted onto the main casing 2. When the drum cartridge 3 is located at the first guide position, the drum shaft 12A (see FIG. 9) is fitted in the guide 51. While the drum cartridge 3 moves from the first guide position to the second guide position, the drum shaft 12A and the handle shaft 33 (see FIG. 10 to FIG. 12) are fitted in the guide 51. That is, the drum shaft 12A is an example of a guided portion guided by the guide 51. The guided portion is not limited to the drum shaft 12A, and may be a boss extending in the axial direction. The guide 51 extends in a moving direction in which the drum cartridge 3 moves from the first guide position to the second guide position. The guide 51 has the upstream end 51A and the downstream end 51B in the drum mounting direction. The drum mounting direction is a direction in which the drum cartridge 3 is guided when being mounted onto the main casing 2. More specifically, the drum mounting direction is a moving direction of the drum cartridge from the first guide position to the second guide position. The downstream end 51B is located between the upstream end 51A and the fixing device 8 in the drum mounting direction. The downstream end 51B is located above the transfer roller 7. The guide 51 may be a groove formed in the inner surface of the main casing 2. The guide 51 may be configured by a rib protruding from the inner surface of the main casing 2.

The guide 51 guides the developing cartridge 4 to a position where the developing roller 14 (see FIG. 1) contacts the photosensitive drum 12 when the developing cartridge 4 (see FIG. 4) is mounted onto the main casing 2.

4. 2 Handle Shaft Guide 52

The handle shaft guide 52 guides the handle shaft 33 (see FIG. 12 and FIG. 13) when the drum cartridge 3 rotationally moves from the second guide position to the third guide position. The handle shaft 33 is fitted in the handle shaft guide 52 when the drum cartridge 3 rotationally moves from the second guide position to the third guide position. The handle shaft guide 52 extends from a middle of the guide 51, in a rotational direction of the drum cartridge 3 from the second guide position to the third guide position. The rotational direction of the drum cartridge from the second guide position to the third guide position is defined as a drum rotational direction. More specifically, the handle shaft guide 52 has an arc shape having the downstream end 51B of the guide 51 as the center. The handle shaft guide 52 is a groove formed in the inner surface of the main casing 2. The handle shaft guide 52 may be configured by a rib protruding from the inner surface of the main casing 2.

4. 3 First Cover Guide 53

The first cover guide 53 moves the first cover 21 (see FIG. 9 to FIG. 12) from the first position to the second position when the drum cartridge 3 moves from the first guide position to the second guide position. The first cover guide 53 keeps the first cover 21 (see FIG. 12 and FIG. 13) at the second position when the drum cartridge 3 moves from the second guide position to the third guide position. The first contact portion 28A (see FIG. 4A) and the second contact portion 29A (see FIG. 4A) are fitted in the first cover guide 53 when the drum cartridge 3 moves from the first guide position to the second guide position. The first cover guide 53 is located below the guide 51. The first cover guide 53 extends in the drum mounting direction. The first cover guide 53 has the third contact portion 53A and the fourth contact portion 53B. More specifically, the first cover guide 53 has the third contact portion 53A, a first contact portion guide 56, and a second contact portion guide 57 having the fourth contact portion 53B. The first cover guide 53 branches into the first contact portion guide 56 and the second contact portion guide 57 having the fourth contact portion 53B at the downstream side of the third contact portion 53A in the drum mounting direction.

4. 3. 1 Third Contact Portion 53A

The third contact portion 53A is located near the upstream end of the first cover guide 53 in the drum mounting direction. The third contact portion 53A is a surface extending in a direction perpendicular to the drum mounting direction. As shown in FIG. 10, the third contact portion 53A contacts the first contact portion 28A of the first cover 21 when the drum cartridge 3 moves from the first guide position to the second guide position. In this manner, as shown in FIG. 11, the first cover 21 rotationally moves from the first position to the second position. At this time, the first cover 21 rotationally moves in the same direction as the drum rotational direction.

4. 3. 2 First Contact Portion Guide 56

When the drum cartridge 3 moves from the first guide position to the second guide position, the first contact portion 28A (see FIG. 4B) of the first cover 21 located at the second position is fitted in the first contact portion guide 56 shown in FIG. 8. The first contact portion guide 56 has an upstream part 56A and a downstream part 56B.

The upstream part 56A guides the first contact portion 28A when the drum cartridge 3 moves from the first guide position to the second guide position. The upstream part 56A is located between the third contact portion 53A and the downstream part 56B in the drum mounting direction. The upstream part 56A is located between the guide 51 and the upstream part 57A of the second contact portion guide 57 in the upper-lower direction. The upstream part 56A extends in the drum mounting direction.

The downstream part 56B guides the first contact portion 28A when the drum cartridge 3 moves from the second guide position to the third guide position. The downstream part 56B is located between the downstream end 51B of the guide 51 and the handle shaft guide 52. The downstream part 56B extends in the drum rotational direction. The downstream part 56B intersects the guide 51.

4. 3. 3 Second Contact Portion Guide 57

The second contact portion 29A (see FIG. 4B) of the first cover 21 located at the second position is fitted in the second contact portion guide 57 when the drum cartridge 3 moves from the first guide position to the second guide position. The second contact portion guide 57 has the upstream part 57A and the downstream part 57B.

The upstream part 57A guides the second contact portion 29A when the drum cartridge 3 moves from the first guide position to the second guide position. The upstream part 57A is located between the third contact portion 53A and the downstream part 57B in the drum mounting direction. The upstream part 57A is located at an opposite side of the guide 51 with respect to the upstream part 56A of the first contact portion guide 56 in the upper-lower direction. The upstream part 57A extends in the drum mounting direction.

The downstream part 57B guides the second contact portion 29A when the drum cartridge 3 moves from the second guide position to the third guide position. The downstream part 57B is located between the downstream end 51B of the guide 51 and the downstream part 56B of the first contact portion guide 56. The downstream part 57B extends in the drum rotational direction. The downstream part 57B intersects the guide 51.

4. 3. 4 Fourth Contact Portion 53B

The fourth contact portion 53B is an inner surface of the downstream part 57B. When the drum cartridge 3 moves from the second guide position to the third guide position, the fourth contact portion 53B contacts the second contact portion 29A (see FIG. 4B) of the first cover 21 located at the second position. In this manner, as shown in FIG. 12 and FIG. 13, the drum cartridge 3 moves from the second guide position to the third guide position in a state where the first cover 21 is kept at the second position.

4. 4 Second Cover Guide 54

The second cover guide 54 shown in FIG. 8 moves the second cover 22 (see FIG. 9 to FIG. 11) from the third position to a fifth position between the third position and the fourth position (see FIG. 11) when the drum cartridge 3 moves from the first guide position to the second guide position. When the drum cartridge 3 moves from the first guide position to the second guide position, the fifth contact portion 32A (see FIG. 4A) of the second cover 22 is fitted in the second cover guide 54. The second cover guide 54 is located above the guide 51. The second cover guide 54 extends in the drum mounting direction. The second cover guide 54 has a sixth contact portion 54A. That is, the main casing 2 has the sixth contact portion 54A.

The sixth contact portion 54A is located near an upstream end of the first cover guide 53 in the drum mounting direction. The sixth contact portion 54A is located at an opposite side of the third contact portion 53A with respect to the guide 51. As shown in FIG. 10, the sixth contact portion 54A contacts the fifth contact portion 32A of the second cover 22 when the drum cartridge 3 moves from the first guide position to the second guide position. In this manner, as shown in FIG. 11, the second cover 22 located at the third position moves to the fifth position between the third position and the fourth position. At this time, the second cover 22 rotationally moves in an opposite direction of the drum rotational direction.

4. 5 Seventh Contact Portion 55

As shown in FIG. 12 and FIG. 13, the seventh contact portion 55 contacts a part of the second cover 22 when the drum cartridge 3 moves from the second guide position to the third guide position. More specifically, the seventh contact portion 55 contacts the eighth contact portion 30B of the cover plate 30 of the second cover 22 when the drum cartridge 3 moves from the second guide position to the third guide position. The seventh contact portion 55 extends in the axial direction. The seventh contact portion 55 has a columnar shape. When the drum cartridge 3 moves from the second guide position to the third guide position, the second cover 22 located at the fifth position further rotationally moves in the opposite direction of the drum rotational direction due to contact of the cover plate 30 of the second cover 22 with the seventh contact portion 55, and is located at the fourth position.

5. Mounting of Drum Cartridge 3 and Developing Cartridge 4 onto Main Casing 2

With reference to FIG. 8 to FIG. 13 and FIG. 1, mounting of the drum cartridge 3 and the developing cartridge 4 onto the main casing 2 will be described below.

Figure 9:
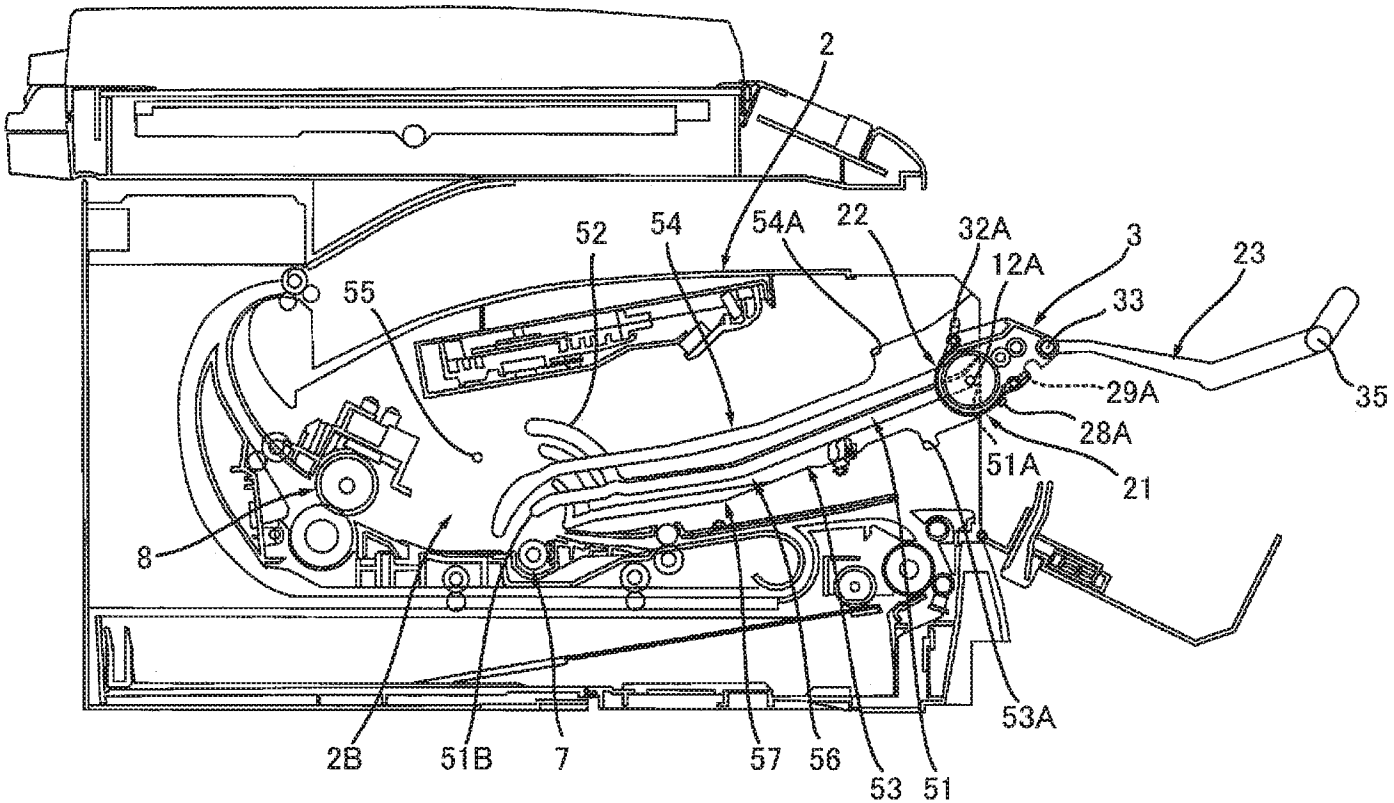
FIG. 9 shows an explanatory diagram for explaining mounting of a drum cartridge onto the main casing, and a state where the drum cartridge is located at a first guide position.

In order to mount the drum cartridge 3 and the developing cartridge 4 onto the main casing 2, as shown in FIG. 8, a user locates a cover 2C at an open position and, as shown in FIG. 9, fits the drum shaft 12A in the upstream end 51A to position the drum cartridge 3 at the first guide position. In this manner, the fifth contact portion 32A of the second cover 22 is fitted in the upstream end of the second cover guide 54.

Next, the user pushes the drum cartridge 3 toward the internal space 2B of the main casing 2.

In this case, the drum cartridge 3 is guided by the guide 51 and moves in the drum mounting direction. In this manner, the first contact portion 28A and the second contact portion 29A of the first cover 21 are fitted in the upper end of the first cover guide 53.

Then, the drum cartridge 3 moves in the drum mounting direction and, as shown in FIG. 10, the first contact portion 28A of the first cover 21 contacts the third contact portion 53A of the first cover guide 53. The fifth contact portion 32A of the second cover 22 contacts the sixth contact portion 54A of the second cover guide 54.

The drum cartridge 3 further moves in the drum mounting direction in a state where the first contact portion 28A contacts the third contact portion 53A and where the fifth contact portion 32A contacts the sixth contact portion 54A. And, as shown in FIG. 11, the first cover 21 moves from the first position to the second position, and the second cover 22 moves from the third position to the fifth position between the third position and the fourth position.

As shown in FIG. 12, the drum cartridge 3 is located at the second guide position when the drum shaft 12A is located at the lower end 51B of the guide 51. At this time, the second contact portion 29A (see FIG. 4B) of the first cover 21 located at the second position contacts the fourth contact portion 53B (see FIG. 8) of the first cover guide 53. The photosensitive drum 12 contacts the transfer roller 7.

Next, the user rotationally moves the drum cartridge 3 about the drum shaft 12A such that the handle shaft 33 moves upward.

In this manner, as shown in FIG. 12 and FIG. 13, the drum cartridge 3 rotationally moves from the second guide position toward the third guide position. At this time, the second contact portion 29A of the first cover 21 is kept in contact with the fourth contact portion 53B of the first cover guide 53. In this manner, the drum cartridge 3 rotationally moves from the second guide position to the third guide position in a state where the first cover 21 is kept at the second position. The cover plate 30 of the second cover 22 contacts the seventh contact portion 55 of the main casing 2.

When the drum cartridge 3 rotationally moves in the drum rotational direction in the state where the cover 30 contacts the seventh contact portion 55, the second cover 22 rotationally moves from the fifth position to the fourth position relative to the photosensitive drum 12.

In this manner, as shown in FIG. 13, when the drum cartridge 3 is located at the third guide position, the second cover 22 is located at the fourth position. The first portion A1 (see FIG. 4A) of the photosensitive drum 12 is located at an upstream in the drum mounting direction with respect to the drum shaft 12A. The second portion A2 (see FIG. 4B) of the photosensitive drum 12 contacts the transfer roller 7.

Next, the user mounts the developing cartridge 4.

Then, as shown in FIG. 1, the handle 23 of the drum cartridge 3 is rotationally moved upward by the rib 42 (see FIG. 7) of the developing cartridge 4. The developing roller 14 passes under the handle 23 having rotationally moved and contacts the first portion A1 of the photosensitive drum 12.

Thereafter, the user locates the cover 2C to a closed position, and the mounting of the drum cartridge 3 and the developing cartridge 4 onto the main casing is ended.

6. Operations and Effects

According to the image forming apparatus 1, as shown in FIG. 10 and FIG. 11, with a simple configuration in which, when the drum cartridge 3 moves from the first guide position to the second guide position, the first contact portion 28A of the first cover 21 contacts the third contact portion 53A of the main casing 2, the first cover 21 is rotationally moved in the same direction as the rotational direction in which the drum cartridge 3 rotationally moves from the second guide position to the third guide position, thereby moving the first cover 21 from the first position to the second position.

As shown in FIG. 12 and FIG. 13, when the drum cartridge 3 rotationally moves from the second guide position to the third guide position, the second contact portion 29A (see FIG. 4B) of the first cover 21 contacts the fourth contact portion 53B (see FIG. 8) of the main casing 2, thereby keeping the first cover 21 at the second position.

As a result, with a simple configuration, by using a mounting operation of the drum cartridge 3 onto the main casing 2, the first cover 21 is moved from the first position to the second position.

While the disclosure has been described in detail with reference to the above aspects thereof, it would be apparent to those skilled in the art that various changes and modifications may be made therein without departing from the scope of the claims.

What is claimed is:

1. An image forming apparatus comprising:

a main casing;

a fixing device accommodated in the main casing; and a drum cartridge configured to be mounted on the main casing in a mounting direction, the drum cartridge comprising:

a photosensitive drum; and a drum cover configured to cover a first part of the photosensitive drum, the drum cover comprising:

a shaft, the drum cover being configured to rotate about the shaft between:

a first position at which the drum cover covers the first part of the photosensitive drum and a second position at which the drum cover does not cover the first part of the photosensitive drum, the main casing comprising:

a guide configured to guide the drum cartridge when the drum cartridge is mounted onto the main casing, the guide comprising:

an upstream end and a downstream end in a mounting direction in which the drum cartridge moves when the drum cartridge is mounted onto the main casing, the downstream end of the guide being located between the upstream end of the guide and the fixing device, the drum cartridge comprising:

a guided portion configured to be guided by the guide, the guide being configured to guide the guided portion from the upstream end of the guide to the downstream end of the guide when the drum cartridge is mounted onto the main casing, wherein, when the drum cartridge is mounted onto the main casing, the drum cartridge is configured to move from a first guide position through a second guide position to a third guide position, the first guide position of the drum cartridge being a position at which the guided portion is located at the upstream end of the guide, the second guide position of the drum cartridge being a position at which the guided portion is located at the downstream end of the guide, and the third guide position of the drum cartridge being a position at which the drum cartridge is rotated, in a particular rotational direction, from the second guide position about the guided portion located at the downstream end.

2. The image forming apparatus according to claim 1, the drum cover further comprising:
a first contact portion; and
a second contact portion,
wherein the main casing further comprises:
a third contact portion configured to contact the first contact portion when the drum cartridge moves from the first guide position to the second guide position; and
a fourth contact portion configured to contact the second contact portion when the drum cartridge moves from the second guide position to the third guide position,
wherein, while the guided portion of the drum cartridge is located between the upstream end of the guide and the downstream end of the guide in the mounting direction, the first contact portion of the drum cover contacts with the third contact portion of the main casing; and
wherein, while the guided portion of the drum cartridge is located at the downstream end of the guide and the drum cartridge rotates from the second guide position to the third guide position, the second contact portion of the drum cover contacts with the fourth contact portion of the main casing.

3. The image forming apparatus according to claim 2, wherein, when the drum cartridge is mounted onto the main casing,
the drum cartridge is configured to move from a first guide position through a second guide position to a third guide position,
wherein the main casing further comprises:
a third contact portion configured to contact the first contact portion when the drum cartridge moves from the first guide position to the second guide position; and
a fourth contact portion configured to contact the second contact portion when the drum cartridge moves from the second guide position to the third guide position,
the drum cartridge is configured such that:
while the drum cartridge moves from the first guide position to the second guide position, the first contact portion of the drum cover contacts with the third contact portion of the main casing; and
while the drum cartridge moves from the second guide position to the third guide position, the second contact portion of the drum cover contacts with the fourth contact portion of the main casing.

4. The image forming apparatus according to claim 3, further comprising:
a developing cartridge configured to be mounted onto the main casing independently from the drum cartridge, the developing cartridge comprising:
a developing roller configured to contact the first part of the photosensitive drum when the developing cartridge is mounted on the main casing in a state where the drum cartridge is located at the third guide position.

5. The image forming apparatus according to claim 4, wherein, in a state where the drum cartridge is located at the third guide position and the developing cartridge is mounted on the main casing, the photosensitive drum is located downstream of the developing roller in a moving direction in which the drum cartridge moves from the first guide position to the second guide position.

6. The image forming apparatus according to claim 3, wherein the drum cartridge further comprises:
a drum frame supporting the photosensitive drum; and
a handle rotatably coupled to the drum frame;
wherein the handle has an arm and a coupling portion coupling the arm and the drum frame,
wherein, when the drum cartridge moves from the first guide position to the second guide position, the coupling portion of the drum frame is located at an upstream of the photosensitive drum in a moving direction in which the drum cartridge moves from the first guide position to the second guide position; and
wherein, when the drum cartridge moves from the second guide position to the third guide position, the coupling portion retracts from the upstream of the photosensitive drum in the moving direction.

7. The image forming apparatus according to claim 3, wherein the drum cartridge further comprises:
a drum frame supporting the photosensitive drum; and
an arm, and
wherein a coupling portion of the drum frame and the arm is located at a higher position when the drum cartridge is located at the third guide position, than when the drum cartridge is located at the second guide position.

8. The image forming apparatus according to claim 1, wherein the photosensitive drum is configured to rotate about a drum shaft extending in an axial direction, and
wherein the guided portion is the drum shaft.

9. The image forming apparatus according to claim 1, wherein the drum cartridge further comprises:
a drum frame supporting the photosensitive drum;
a handle rotatably connected to the drum frame, the handle being rotatably moved about a handle shaft; and
a drum shaft extending in an axial direction, the photosensitive drum being configured to rotate about the drum shaft, the guided portion being the drum shaft,
wherein the drum cartridge has a first length except for the handle in a direction in which a first central axis line of the drum shaft and a second central axis line of the handle shaft are connected to each other, and
wherein the drum cartridge has a second length in a direction perpendicular to a direction in which the first central axis line and the second central axis line are connected to each other, the second length being shorter than the first length.

10. The image forming apparatus according to claim 3, wherein the main casing further comprises:
a second contact portion guide in which the second contact portion of the drum cover is fitted when the drum cover is located at the second position and the drum cartridge moves from the first guide position to the second guide position,
the second contact portion guide comprising:
an upstream part; and
a downstream part,
wherein the upstream part guides the second contact portion when the drum cartridge moves from the first guide position to the second guide position, the upstream part extending in the mounting direction,
wherein the downstream part guides the second contact portion when the drum cartridge moves from the second guide position to the third guide position, the downstream part extending in a drum rotational direction in which the drum cartridge rotates between the second guide position and the third guide position, and wherein the fourth contact portion is an inner surface of the downstream part.

11. A drum cartridge for use with an image forming apparatus, comprising:

a photosensitive drum;

a first cover configured to cover a first part of the photosensitive drum, the first cover comprising:

a first shaft, the first cover being configured to rotate about the first shaft between:

a first position at which the first cover covers the first part of the photosensitive drum and a second position at which the first cover does not cover the first part of the photosensitive drum; and a second cover configured to cover a second part of the photosensitive drum, the second part being different from the first part of the photosensitive drum which is covered by the first cover, the second cover comprising:

a second shaft, the second cover being configured to rotate about the second shaft between:

a third position at which the second cover covers the second part of the photosensitive drum and a fourth position at which the second cover does not cover the second part of the photosensitive drum, wherein, when the drum cartridge is attached to the image forming apparatus, the first cover is rotated about the first shaft from the first position to the second position; and wherein, when the drum cartridge is attached to the image forming apparatus, the second cover is rotated about the second shaft from the third position to the fourth position.

12. The drum cartridge according to claim 11, wherein, in a state where the first cover is located at the first position and the second cover is located at the third position, a free end of the first cover and a free end of the second cover face each other in a circumferential direction of the photosensitive drum.

13. The drum cartridge according to claim 11, further comprising:

a drum frame supporting the photosensitive drum;

a handle rotatably connected to the drum frame, the handle being rotatable about a handle shaft; and a drum shaft extending in an axial direction of the photosensitive drum, the photosensitive drum being configured to rotate about the drum shaft.

* * * * *